US008002269B2

(12) United States Patent
Asada et al.

(10) Patent No.: US 8,002,269 B2
(45) Date of Patent: Aug. 23, 2011

(54) SHEET SUPPLYING APPARATUS

(75) Inventors: Tetsuo Asada, Kuwana (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 148 days.

(21) Appl. No.: 11/625,965

(22) Filed: Jan. 23, 2007

(65) Prior Publication Data

US 2007/0170641 A1 Jul. 26, 2007

(30) Foreign Application Priority Data

Jan. 24, 2006 (JP) ..... 2006-014770

(51) Int. Cl.
*B65H 1/00* (2006.01)
*B65H 1/02* (2006.01)
*B65H 1/22* (2006.01)

(52) U.S. Cl. ..... 271/145; 271/147; 271/160; 271/162

(58) Field of Classification Search ..... 271/145, 271/160, 162, 147
See application file for complete search history.

(56) References Cited

U.S. PATENT DOCUMENTS

| | | | | |
|---|---|---|---|---|
| 4,280,692 | A * | 7/1981 | Hutchinson et al. | 271/160 |
| 5,005,818 | A * | 4/1991 | Hayashi et al. | 271/107 |
| 5,419,544 | A * | 5/1995 | Ono et al. | 271/164 |
| 5,512,928 | A * | 4/1996 | Kato et al. | 347/138 |
| 5,593,152 | A * | 1/1997 | Wirth et al. | 271/241 |
| 5,918,875 | A * | 7/1999 | Masley et al. | 271/162 |
| 6,102,386 | A * | 8/2000 | Shigetomi et al. | 271/9.11 |
| 6,279,897 | B1 * | 8/2001 | Richards | 271/121 |
| 6,296,244 | B1 * | 10/2001 | Hanks et al. | 271/118 |
| 6,422,772 | B1 * | 7/2002 | Fisher et al. | 400/629 |
| 6,422,773 | B1 * | 7/2002 | Lim | 400/710 |
| 7,147,219 | B2 * | 12/2006 | Soo | 271/157 |
| 7,481,419 | B2 * | 1/2009 | Kim | 271/9.01 |
| 2005/0180797 | A1 * | 8/2005 | Hattori | 400/624 |
| 2006/0145409 | A1 * | 7/2006 | Able et al. | 271/10.01 |
| 2006/0180996 | A1 * | 8/2006 | Iwase et al. | 271/162 |
| 2007/0120317 | A1 * | 5/2007 | Takahashi et al. | 271/145 |

FOREIGN PATENT DOCUMENTS

| | | | |
|---|---|---|---|
| JP | 62259931 | * | 11/1987 |
| JP | 03249025 | * | 11/1991 |
| JP | H05-092825 | A | 4/1993 |
| JP | H09-150966 | A | 6/1997 |

* cited by examiner

*Primary Examiner* — Patrick Mackey
*Assistant Examiner* — Patrick Cicchino
(74) *Attorney, Agent, or Firm* — Baker Botts L.L.P.

(57) ABSTRACT a sheet supplying apparatus, comprising a housing; and a sheet-supply tray which supports a plurality of sheets and which is insertable into the housing. The sheet-supply tray includes at least one first engageable portion. The housing includes at least one second engageable portion which is engaged, in a state in which the sheet-supply tray is inserted in the housing, with the at least one first engageable portion of the sheet-supply tray. The sheet-supply tray further includes a guide portion having an inclined guide surface which guides a movement of each of the sheets supplied from the sheet-supply tray, and at least a portion of the at least one first engageable portion is provided in a rear space located in rear of the guide portion.

25 Claims, 9 Drawing Sheets

SHEET SUPPLYING APPARATUS

The present application is based on Japanese Patent Application No. 2006-014770 filed on Jan. 24, 2006, the contents of which are incorporated herein by reference.

BACKGROUND OF THE INVENTION

1. Field of the Invention

The present invention relates to a sheet supplying apparatus and in particular to such a sheet supplying apparatus that can stably supply sheets and can enjoy a reduced size.

2. Discussion of Related Art

There has conventionally been known a sheet supplying apparatus including a housing, a sheet-supply tray, and an attaching device that attaches the sheet-supply tray inserted in the housing, to the housing. For example, Japanese Patent Application Publication No. 9-150966 discloses a sheet supplying apparatus including a housing; a sheet-supply cassette that accommodates sheets and that is insertable into the housing, wherein the sheet-supply cassette has an engageable recess and an engageable projection; and a lever that is engaged, in a state in which the cassette is inserted in the housing, with the engageable recess and projection so as to attach the cassette to the housing. Thus, the sheet-supply cassette is prevented from rattling relative to the housing, and the sheets accommodated by the cassette are accurately positioned relative to the housing. Therefore, the sheets can be stably supplied from the cassette.

In addition, Japanese Patent Application Publication No. 5-92825 discloses an image forming apparatus including a housing; a sheet-supply cassette that accommodates sheets and that is insertable into the housing; and a locking device that includes a first engageable portion provided on the sheet-supply cassette and a second engageable portion provided on the housing, and that locks the cassette to the housing. In a state in which the cassette is inserted in the housing, the first and second engageable portions are engaged with each other so that the cassette is locked to the housing. Thus, in this image forming apparatus, too, the sheet-supply cassette is prevented from rattling relative to the housing, and the sheets accommodated by the cassette are accurately positioned relative to the housing. Therefore, the sheets can be stably supplied from the cassette.

However, in the sheet supplying apparatus disclosed by Japanese Patent Document No. 9-150966, the engageable projection projects upward from an upper portion of the sheet-supply cassette and accordingly the lever must be provided above the cassette. Thus, the size of the housing is inevitably increased. In addition, in the locking device disclosed by Japanese Patent Document No. 6-92825, the first engageable portion projects laterally from the sheet-supply cassette and accordingly the size of the housing is inevitably increased.

SUMMARY OF THE INVENTION

In the above-described background, the present invention has been developed. It is therefore an object of the present invention to solve at least one of the above-indicated problems. It is another object of the present invention to provide a sheet supplying apparatus that can stably supply each of a plurality of sheets and/or can enjoy a reduced size.

According to the present invention, there is provided a sheet supplying apparatus, comprising a housing; and a sheet-supply tray which supports a plurality of sheets and which is insertable into the housing. The sheet-supply tray includes at least one first engageable portion. The housing includes at least one second engageable portion which is engaged, in a state in which the sheet-supply tray is inserted in the housing, with the at least one first engageable portion of the sheet-supply tray. The sheet-supply tray further includes a guide portion having an inclined guide surface which guides a movement of each of the sheets supplied from the sheet-supply tray, and at least a portion of the at least one first engageable portion is provided in a rear space located in rear of the guide portion.

In the present sheet supplying apparatus, in the state in which the sheet-supply tray is inserted in the housing, the sheets supported by the tray are supplied, one by one, while being guided by the inclined guide surface of the guide portion. Thus, the uppermost one of the sheets is separated from the other sheets remaining in the tray by the inclined guide surface. In this state, the first engageable portion of the sheet-supply tray and the second engageable portion of the housing are engaged with each other. Therefore, the sheet-supply tray is effectively prevented from rattling relative to the housing, and the sheets supported by the tray are accurately positioned relative to the housing. Therefore, the sheets can be stably supplied from the tray to, e.g., an image recording device provided in the housing. In addition, since at least a portion of the first engageable portion is provided in the rear space located in rear of the inclined guide portion, an amount of projection of the first engageable portion from the tray can be decreased or even zeroed and accordingly the size of the sheet supplying apparatus as a whole can be reduced as such.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
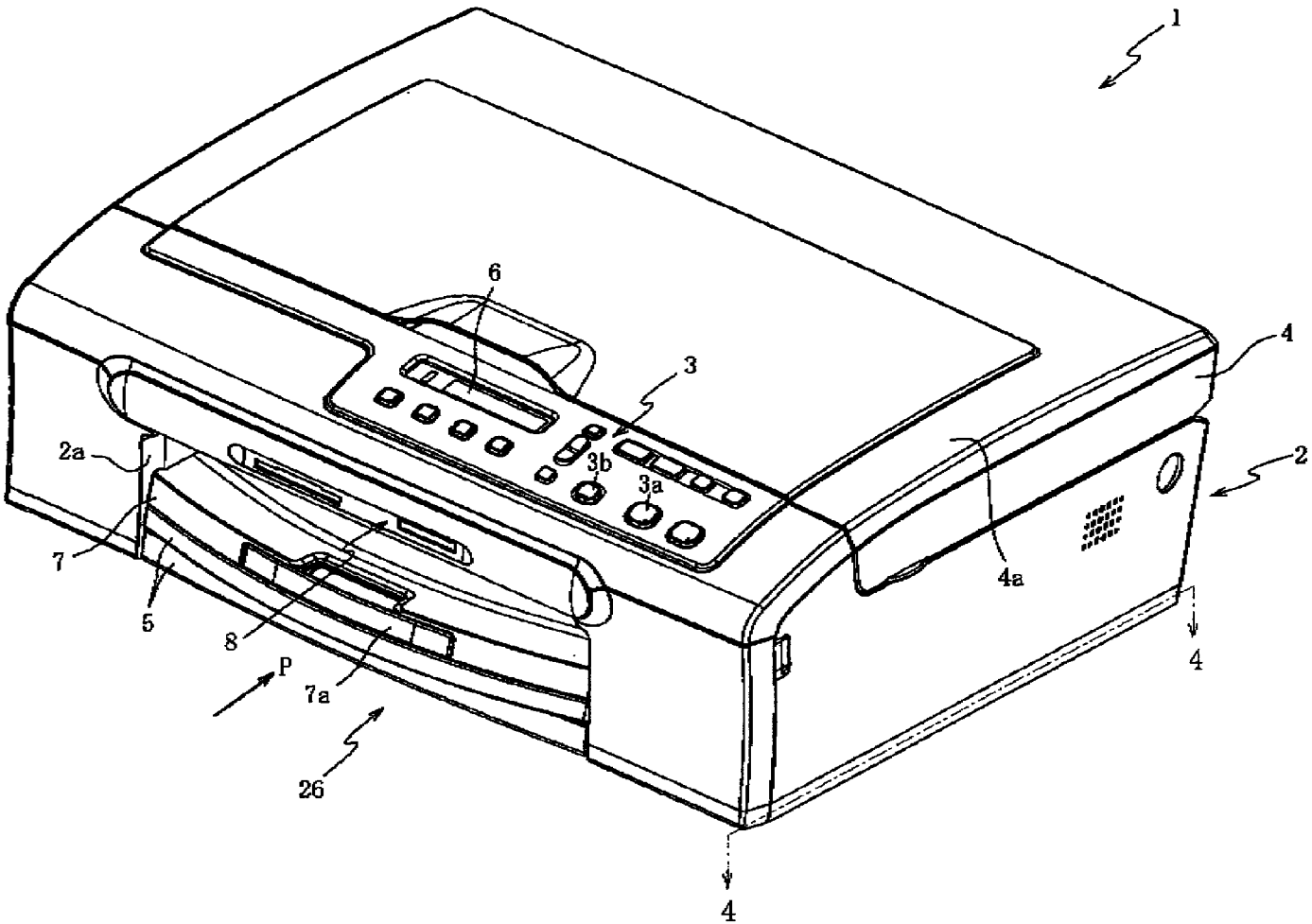
FIG. 1 is a perspective view showing an external construction of a multi-function peripheral machine to which the present invention is applied.

Hereinafter, there will be described preferred embodiments of the present invention by reference to the drawings. FIG. 1 is a perspective view showing an external construction of a multi-function peripheral machine 1 to which the present invention is applied. The peripheral machine 1 has various functions such as a facsimile-machine function, a printer function, a scanner function, a copier function, and a video-printer function, and includes a sheet supplying apparatus 26 that supplies one or more recording sheets when an image or images is or are recorded on the recording sheet(s) in relation to each of those functions.

As shown in FIG. 1, the multi-function peripheral machine 1 includes, as a main body or frame thereof, a housing 2 having a box-like configuration. An operation panel 3 is provided in a front portion of an upper surface of the housing 2. The operation panel 3 includes a start button 3*a*, a stop button 3*b*, and other buttons and, when an arbitrary one of those buttons is depressed by a user, a corresponding one of various operations is carried out by the peripheral machine 1.

On a left-hand side of the operation panel 3 in FIG. 1, there is provided a rectangular liquid crystal display (hereinafter, referred to as the "LCD") 6. The LCD 6 displays, as needed, the current status of the peripheral machine 1 and/or various messages directed to the user. For example, when the peripheral machine 1 is in a waiting state thereof, the LCD 6 displays the current day time. The day time may be set by the user through the operation of the operation panel 3.

In rear of the LCD 6, i.e., on a right-hand side of the LCD 6 in FIG. 1, there is provided an original-sheet support portion 4 on which an original sheet having an original image is placed when the original image is read in relation to the scanner function or when the original image is copied in relation to the copier function. A cover member 4*a* is provided above the original-sheet support portion 4, such that the cover member 4*a* is pivotable upward and downward. The user opens the cover member 4*a* by pivoting the same 4*a* upward, and places a desirable original sheet on the original-sheet support portion 4. After the cover member 4*a* is closed, a desirable function such as the scanner function or the copier function is performed by operating the operation panel 3.

In a front portion of the housing 2 in FIG. 1, there is provided a sheet-supply tray 5 that supports or accommodates a plurality of stacked recording sheets, not shown. The sheet-supply tray 5 can be inserted into, and removed from, the housing 2 through an insertion hole 2*a* thereof that has a rectangular cross section. The sheet-supply tray 5 is inserted into the housing 2 in a direction indicated by Arrow, P, in FIG. 1. In a state in which the sheet-supply tray 5 is inserted in the housing 2, the recording sheets accommodated by the sheet-supply tray 5 are supplied, one by one, from the tray 5 to an ink-jet printer head as an image recording device (not shown), in a direction indicated by Arrow, R, in FIG. 2. After the ink-jet printer head, provided in the housing 2, records an image on the recording sheet, the recording sheet is discharged onto a sheet-discharge portion 7 provided above the sheet-supply tray 5, in a direction opposite to the direction P. The sheet-discharge portion 7 includes an extensible portion 7*a* that is extensible from a remaining portion thereof. The user can extend, as needed, the extensible portion 7*a* from the sheet-discharge portion 7, so that the discharged sheet(s) is(are) held on the sheet-discharge portion 7 and the extensible portion 7*a*, without falling down therefrom.

Above the sheet-discharge portion 7 in FIG. 1, there is provided a slot portion 8 into which a recording medium (not shown) such as a memory card can be inserted Data recorded or stored on the recording medium, inserted in the slot portion 8, can be read by a control device (not shown; e.g., a computer) of the peripheral machine 1, so that an image or images is or are recorded on a recording sheet or sheets by the ink-jet printer head.

Figure 2:
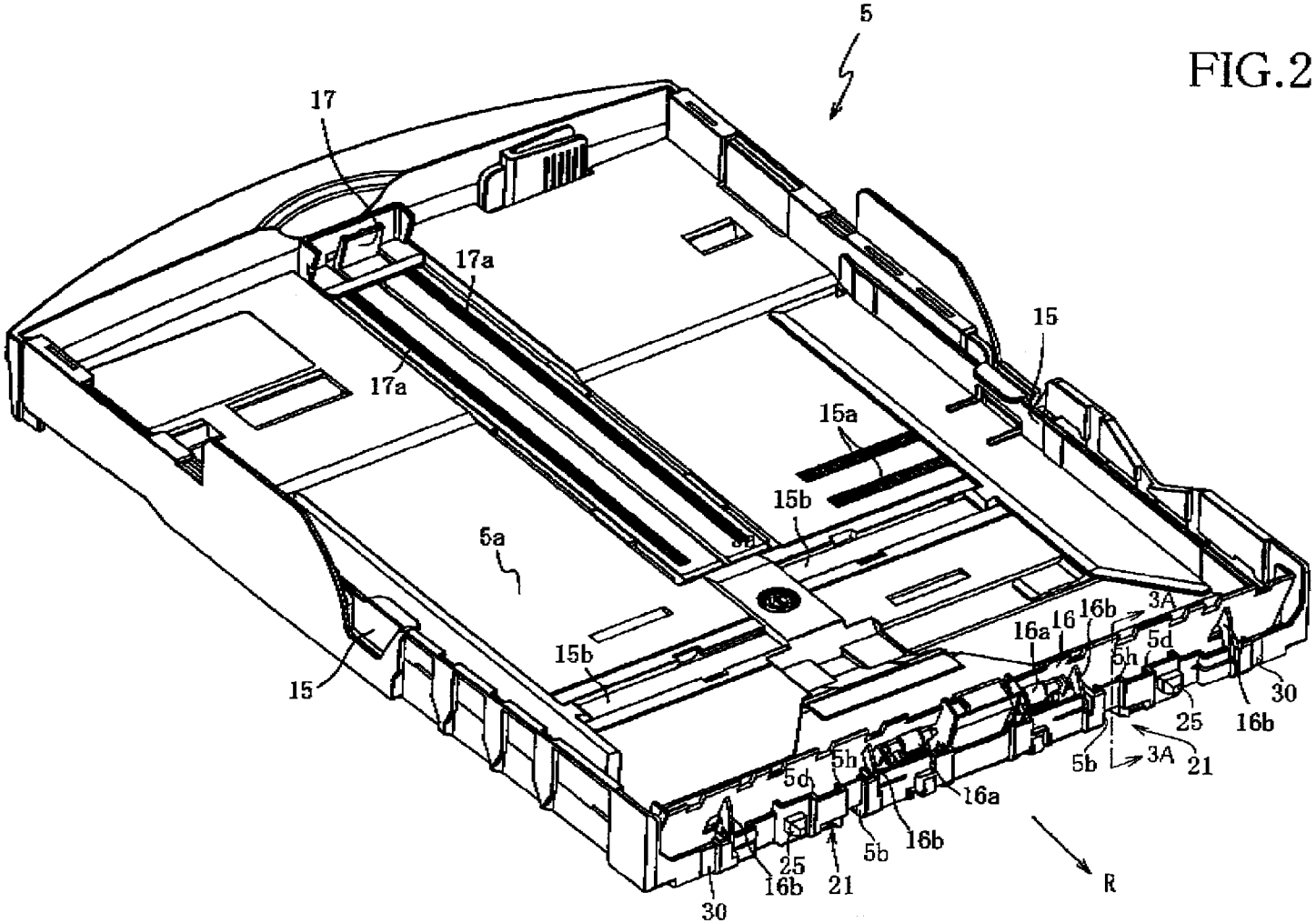
FIG. 2 is a perspective view of a sheet-supply tray of a sheet supplying apparatus employed by the peripheral machine.

Next, there will be described the sheet-supply tray 5 of the sheet supplying apparatus 26, by reference to FIG. 2. FIG. 2 is a perspective view of the sheet-supply tray 5 as a portion of the sheet supplying apparatus 26. As shown in FIG. 2, the sheet-supply tray 5 has a generally rectangular-parallelepiped shape that opens upward. The sheet-supply tray 5 has a flat sheet-support surface (i.e., bottom surface) 5*a* that supports the recording sheets stacked on each other, and is insertable into the housing 2 through the insertion hole 2*a* in the direction indicated by Arrow P (FIG. 1).

Along two opposite side walls of the sheet-supply tray 5, there are provided two guide members 15, 15 that cooperate with each other to guide a movement of each of the stacked recording sheets in the direction R. The two guide members 15, 15 include respective slidable portions 15*a*, 15*a* that are slidable in an interlocked manner via racks and a pinion (not shown), in opposite directions perpendicular to the direction P or R, while a distance between the two guide members 15, 15 is changed along respective grooves 15*b*, 15*b*. Thus, the two guide members 15, 15 can closely contact widthwise opposite edges of each of the stacked recording sheets and thereby guide the movement thereof in the direction R.

Figure 3A:
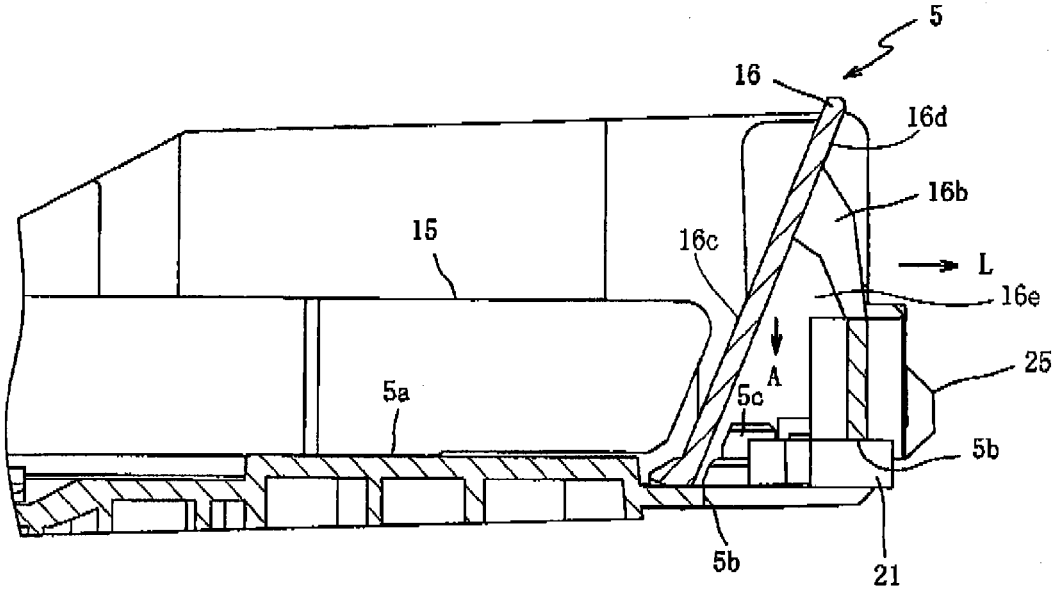
FIG. 3A is an enlarged cross-section view of the sheet-supply tray, taken along 3A-3A in FIG. 2.

In addition, the sheet-supply tray 5 includes a rectangular bank wall 16 as a guide portion that is provided in a rear end portion of the tray 5, extends in a widthwise direction thereof, and has an inclined guide surface 16*c* (FIG. 3A) that is inclined relative to the sheet-support surface 5*a*; a front-edge positioning member 17 that is provided in a front end portion of the tray 5 and that positions respective front edges of the stacked recording sheets relative to the bank wall 16; and two grooves 17*a*, 17*a* along which the positioning member 17 is movable in each of the direction P and a direction opposite to the direction P. The bank wall 16 additionally has a rear surface 16*d* that is opposite to the inclined guide surface 16*c* and supports two rollers 16*a*, 16*a* that are rotatable about respective axis lines each extending in the widthwise direction of the tray 5 that is perpendicular to the direction P. The rollers 16 are exposed in the inclined guide surface 16*c* so as to contact each recording sheet being moved while being guided by the guide surface 16*c*. The rear surface 16*d* is equipped with four support portions 16*b* that cooperate with each other to support the bank wall 16 such that the bank wall 16 is inclined by a predetermined angle relative to the sheet-support surface 5*a*, as shown in FIG. 3A. The positioning member 17 can be moved by the user along the two grooves 17*a*, 17*a*, depending upon the size of the recording sheets used, so that respective rear edges of the recording sheets are held in close contact with the bank wall 16. Since the bank wall 16 is inclined relative to the sheet-support surface 5*a*, a rear space 16*e* is defined by the rear surface 16*d* and a plane containing the sheet-support surface 5*a*.

The sheet supplying apparatus 26 additionally includes a feed roller (not shown) that is rotatable about an axis line extending in the widthwise direction of the sheet-supply tray 5 perpendicular to the direction P. In the state in which the sheet-supply tray 5 is inserted in the housing 2, the feed roller is biased against an uppermost one of the recording sheets stacked in the tray 5. When the feed roller is rotated by an electric motor (not shown), the uppermost recording sheet is moved toward the inclined guide surface 16*c* of the bank wall 16, and is guided by the guide surface 16*c* toward the ink-jet printer head provided in the housing 2.

In the present embodiment, the bank wall 16 is formed of POM (polyoxymethylene, i.e., polyacetal), and the remaining portions of the sheet-supply tray 5 are formed of ABS (acrylonitrile butadiene styrene). Generally, POM has a characteristic that its friction coefficient is smaller than respective friction coefficients of other sorts of resins such as ABS. Thus, the friction coefficient of the bank wall 16 is smaller than that of the remaining portions of the sheet-supply tray 5 and accordingly the separated recording sheet can be moved smoothly over the bank wall 16 toward the ink-jet printer head. In addition, since the two rollers 16*a* are rotated upon engagement with the separated recording sheet, the recording sheet can be more easily moved toward the printer head.

Next, there will be described two first engageable portions 21 of the sheet-supply tray 5, by reference to FIGS. 3A and 3B (however, only one first engageable portion 21 is shown). FIG. 3A is an enlarged cross-section view of the sheet-supply tray 5, taken along 3A-3A in FIG. 2; and FIG. 3B is an enlarged plan view of one of the two first engageable portions 21 as seen in a direction indicated by Arrow, A, in FIG. 3A.

As shown in FIG. 3A, at least a portion of each of the two engageable portions 21 is provided in the rear space 16*e* located in rear of the bank wall 16, i.e., in a downstream-side end portion of the tray 5 in a direction indicated by Arrow, L, i.e., the direction P (FIG. 1). In addition, the sheet-supply tray 5 has, in a rear-end wall thereof, two entrance holes 5*b*, 5*b* (FIG. 2) which two second engageable portions 22, 22 (FIG. 4) of the housing 2 can enter, respectively. More specifically described, when the sheet-supply tray 5 is inserted into the housing 2, the two second engageable portions 22 enter the two entrance holes 5*b*, respectively, so that the two second engageable portions 22 are engaged with the two first engageable portions 21, respectively, and the tray 5 is detachably attached to the housing 2. Moreover, the sheet-supply tray 5 has, in rear of the bank wall 16, two cylindrical projections 5*c*, 5*c* (however, only one projection 5*c* is shown) that support the two first engageable portions 21, respectively, such that the two first engageable portions 21 are rotatable about the respective cylindrical projections 5*c*, i.e., respective axis lines that are perpendicular to the plane containing the sheet-support surface 5*a*.

Figure 3B:
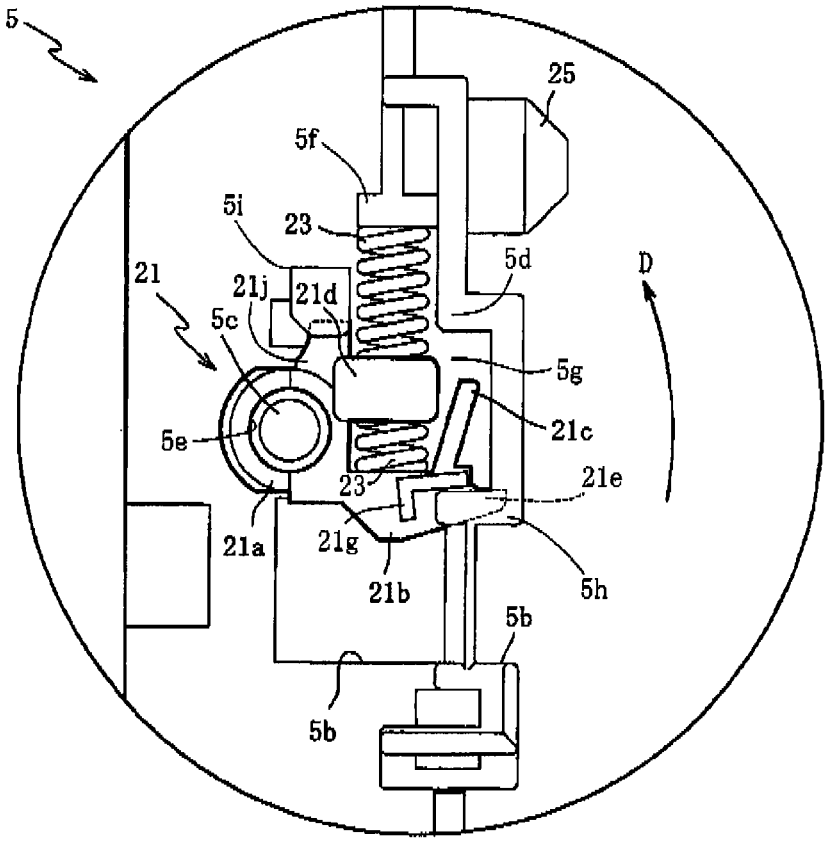
FIG. 3B is an enlarged plan view of one of two first engageable portions of the sheet-supply tray, as seen in a direction indicated by arrow, A, in FIG. 3A.

As shown in FIG. 3B, each of the two first engageable portions 21 includes an annular base portion 21*a* that has a cylindrical inner hole 5*e* and fits on a corresponding one of the two cylindrical projections 5*c* such that the each first engageable portion 21 is rotatable about the corresponding cylindrical projection 5*c*; an operative portion 21*b* that is integrally connected to the base portion 21*a* and is engageable with a corresponding one of the two second engageable portions 22 (FIG. 4); and a first stopper portion 21*c* that is integrally connected to the base portion 21*a* via the operative portion 21*b* such that the first stopper portion 21*c* projects from the operative portion 21*b* in a direction parallel to the sheet-support surface 5*a*. When one of the two first engageable portions 21 is engaged with the corresponding second engageable portion 22 and is rotated in one (indicated by Arrow, D) of opposite directions, the first stopper portion 21*c* thereof butts on a corresponding one of two second stopper portions 5*d* (FIG. 2) of the rear-end wall of the sheet-supply tray 5, thereby stopping the rotation of the one first engageable portion 21 in the rotation D. Thus, the second stopper portion 5*d* defines a limit of rotation of the one first engageable portion 21.

The two first engageable portions 21 are constructed to be symmetrical with each other with respect to a longitudinal centerline of the sheet-supply tray 5 that is parallel to the direction P. Therefore, when the other first engageable portion 21 (not shown) than the above-described one first engageable portion 21, shown in FIG. 3A, is engaged with the corresponding, other second engageable portion 22 (FIG. 4), the other first engageable portion 21 is rotated in the other (indicated by Arrow, S, in FIG. 5C) of the opposite directions, and the first stopper portion 21*c* thereof butts on the other second stopper portion 5*d* (FIG. 2) of the rear-end wall of the sheet-supply tray 5, thereby stopping the rotation of the other first engageable portion 21 in the direction S. Thus, the other second stopper portion 5*d* defines a limit of rotation of the other first engageable portion 21.

In addition, each of the two first engageable portions 21 includes a cylindrical, holding portion 21*d* that is integrally connected to the rotatable base portion 21*a*. As will be described below, a compression coil spring 23 as a sort of biasing member extends through an inner hole of the holding portion 21*d*, such that the holding portion 21*d* holds an intermediate portion of the coil spring 23 so as to restrict a direction in which the coil spring 23 is flexed and prevent the spring 23 from falling off the sheet-supply tray 5. The coil spring 23 is supported, at one end thereof, by the operative portion 21*b* and is also supported, at the other end thereof, by a spring-support portion 5*f* of the rear-end wall of the sheet-supply tray 5. Thus, one coil spring 23 corresponding to the above-described one first engageable portion 21 biases the one first engageable portion 21 in the direction S opposite to the direction D; and the other coil spring 23 corresponding to the above-described other first engageable portion 21 biases the other first engageable portion 21 in the direction D opposite to the direction S. Thus, the two first engageable portions 21 are engaged with the two second engageable portions 22, respectively.

The sheet-supply tray 5 has two generally truncated-pyramidal insertion portions 25, 25 (FIG. 1) that horizontally project rearward from the rear-end wall of the tray 5. The housing 2 has two receiving portions 25*a*, 25*a* (FIG. 4) that receive respective free end portions of the two insertion portions 25, 25 when the sheet-supply tray 5 is inserted into the housing 2. Thus, in the state in which the tray 5 is inserted in the housing 2, the tray 5 is prevented from rattling relative to the housing 2.

Figure 4:
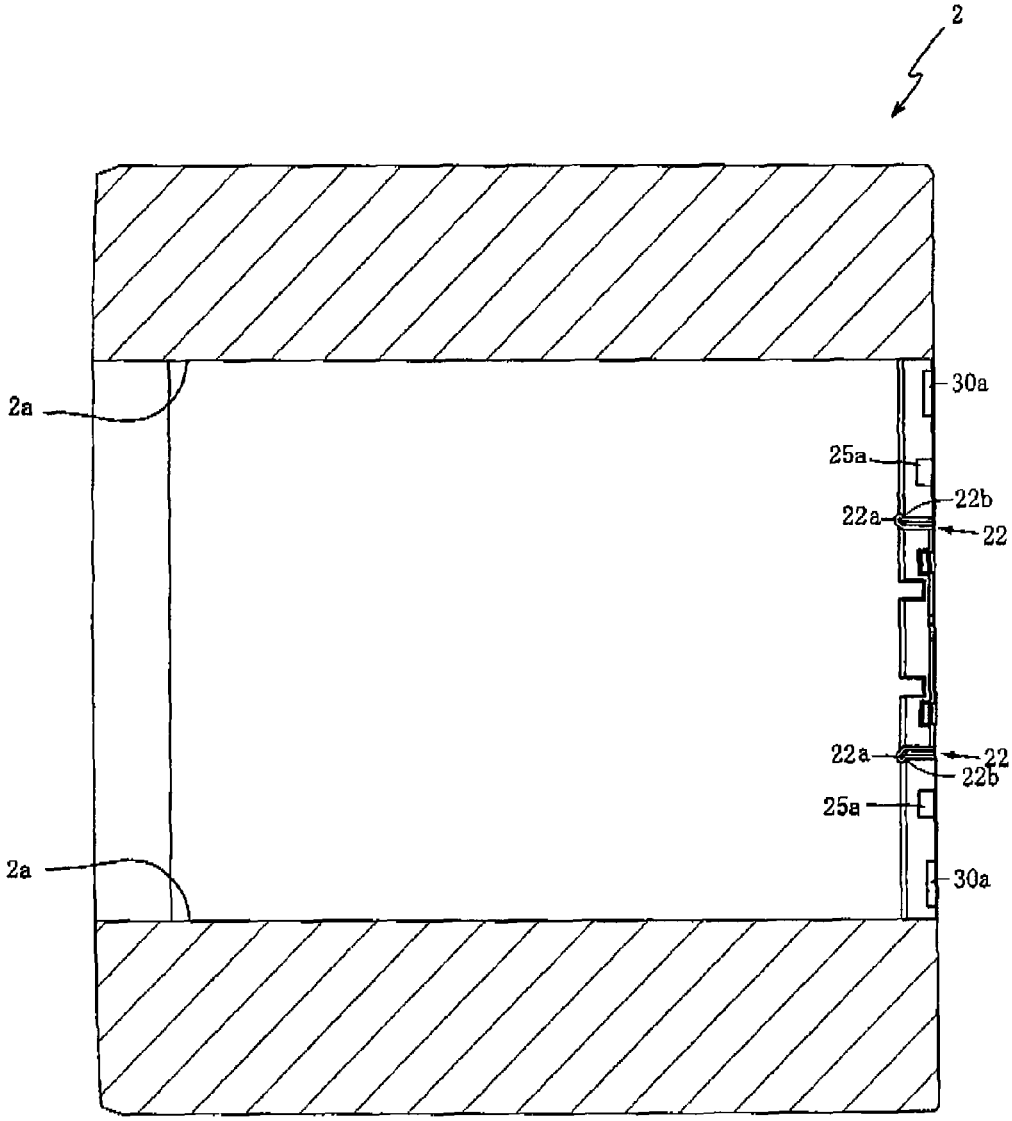
FIGS. 4 is a cross-section view of a housing of the peripheral machine, taken along 4-4 in FIG. 1.

Next, there will be described the two second engageable portions 22 of the housing 2, by reference to FIG. 4. FIG. 4 is a cross-section view of the housing 2, taken along 4-4 in FIG. 1. As shown in FIG. 4, the housing 2 has the insertion hole 2*a* having the rectangular cross section. In addition, the housing 2 has, at a rear end (i.e., a right-hand end in FIG. 4) of the insertion hole 2*a*, the two second engageable portions 22 that project horizontally frontward, i.e., in a direction opposite to the direction P in which the sheet-supply tray 5 is inserted in the insertion hole 2*a*. More specifically described, the two second engageable portions 22 each extend, from the rear end of the insertion hole 2*a*, in the direction opposite to the direction P of insertion of the tray 5, such that respective free end portions 22*a* thereof project in respective oblique directions having, as respective components thereof opposite directions that are perpendicular to the direction P of insertion of the tray 5. Thus, the two second engageable portions 22 are constructed to be symmetrical with each other with respect to a longitudinal centerline of the insertion hole 2*a* or the housing 2 that is parallel to the direction P. Therefore, when the sheet-supply tray 5 is inserted into the insertion hole 2*a*, the two second engageable portions 22 are engaged with the two first engageable portions 21, respectively. More specifically described, if the two second engageable portions 22 are being engaged with the two first engageable portions 21, respectively, in an appropriate manner in which a middle position between the two first enageable portions 21 in the widthwise direction of the sheet-supply tray 5, or the longitudinal centerline of the tray 5 coincides with a middle position between the two second enageable portions 22 of the housing 2, or the longitudinal centerline of the housing 2, only respective small gaps (e.g., about 0.2 mm) are left between the respective first stopper portions 21*c* and the corresponding second stopper portions 5*d*. Therefore, when the longitudinal centerline of the tray 5 is deviated from the longitudinal centerline of the housing 2 during the insertion of the tray 5 into the housing 2, the two second stopper portions 5*d* are enagageable with the corresponding first stopper portions 21*c* so as to stop the respective rotations thereof in the first direction D and the second direction S, and thereby restrict the position of the tray 5 relative to the housing 2 in the widthwise direction of the tray 5 that is perpendicular to the insertion direction P.

In addition, the two receiving portions 25*a* each of which has a generally rectangular-parallelepiped shape with a receiving recess or hole (not shown) formed therein, are provided on respective outer sides of the two second engageable portions 22 of the housing 2, as shown in FIG. 4. When the sheet-supply tray 5 is inserted in the insertion hole 2*a*, the two insertion portions 25, 25 of the tray 5 are received by the respective receiving holes of the two receiver portions 25*a*. Thus, the two insertion portions 25, 25 of the tray 5 and the two receiving portions 25*a* of the housing 2 cooperate with each other to provide a first positioning device that positions the tray 5 relative to the housing 2 with respect to the widthwise direction of the tray 5. In addition, the sheet-supply tray 5 has two first butting portions 30, 30 provided on respective outer sides of the two insertions portions 25, as shown in FIG. 2; and the housing has two second butting portions 30*a*, 30*a* provided on respective outer sides of the two receiving portions 25*a*, 25*a*, as shown in FIG. 4. When the sheet-supply tray 5 is inserted in the insertion hole 2*a*, the two first butting portions 30, 30 butt on the two second butting portions 30*a*, 30*a*, respectively, so that the tray 5 is positioned relative to the housing in the insertion direction P (FIG. 1). Thus, the two first butting portions 30, 30 of the tray 5 and the two second butting portions 30*a* of the housing 2 cooperate with each other to provide a second positioning device that positions the tray 5 relative to the housing 2 with respect to the insertion direction P.

Meanwhile, the two second stopper portions 5*d* define respective rotation spaces 5*g* (only one space 5*g* is shown in FIG. 3B) within which the two first stopper portions 21*c* are allowed to be rotated when the corresponding base portions 21*a* are rotated about the respective cylindrical projections 5*c*. Each of the two first stopper portions 21*c* is elastically deformable or bendable relative to a corresponding one of the two base portions 21*a* and, when each first engageable portion 21 is assembled into the tray 5, the each first stopper portion 21*c* is elastically bent by a worker to be accommodated by a corresponding one of the two rotation spaces 5*g*, and then is allowed to be elastically restored, in a state in which the each first stopper portion 21*c* is accommodated by the corresponding rotation space 5*g*, to its original shape in which the each first stopper portion 21*c* cannot be removed from the corresponding rotation space 5*g*. More specifically described, in a first state in which the base portion 21*a* of each first engageable portion 21 takes, relative to the corresponding cylindrical projection 5*c*, a first angular phase in which the first stopper portion 21*c* is not aligned with the rotation space 5*g*, e.g., is angularly distant from the rotation space 6*g* in the direction I) in FIG. 3B, the base portion 21*a* is allowed to fit on, and be removed from, the cylindrical projection 5*c* while the first stopper portion 21*c* continues to have its original shape (i.e., the stopper portion 21*c* need not be elastically bent). However, in a second state in which the base portion 21*a* takes, relative to the cylindrical projection 5*c*, a second angular phase which is different from the first angular phase and in which the first stopper portion 21*c* is accommodated by the rotation space 5*g*, the first engageable portion 21 is restricted from being moved upward because a projection 21*j* of the base portion 21*a* thereof is interfered with by a corresponding one of two restrictive portions 5*i* (only one restrictive portion 5*i* is shown in FIG. 3B) of the tray 5, and a projection 21*e* of the operative portion 21*b* is interfered with by a corresponding one of two shoulder portions 5*h* (FIG. 2) of the tray 5. In addition, the rotation of the first engageable portion 21 in the direction D is restricted because the first stopper portion 21*c* is interfered with by the second stopper portion 5*d* of the tray 5, and the rotation of the first engageable portion 21 in the direction S opposite to the direction D is restricted because a rib 21*g*, provided between the operative portion 21*b* and the first stopper portion 21*c*, is interfered with by the shoulder portion 5*h* of the tray 5* Thus, each first engageable portion 21 cannot be removed from the corresponding rotation space 5*g*. When each first engageable portion 21 is assembled into the tray 5, the base portion 21*a* takes the first angular phase in which the restrictive portion 5*i* is located between the first stopper portion 21*c* and the projection 21*j* of the base portion 21*a* in the direction D, so that the base portion 21*a* is allowed to fit on the cylindrical projection 5*c*, and subsequently the first engageable portion 21 is rotated by the worker in the direction S opposite to the direction D, so that the first stopper portion 21*c* is elastically deformed or bent by the engagement thereof with the second stopper portion 5*d* and eventually is allowed to be accommodated by the rotation space 5*g*.

Figure 5A:
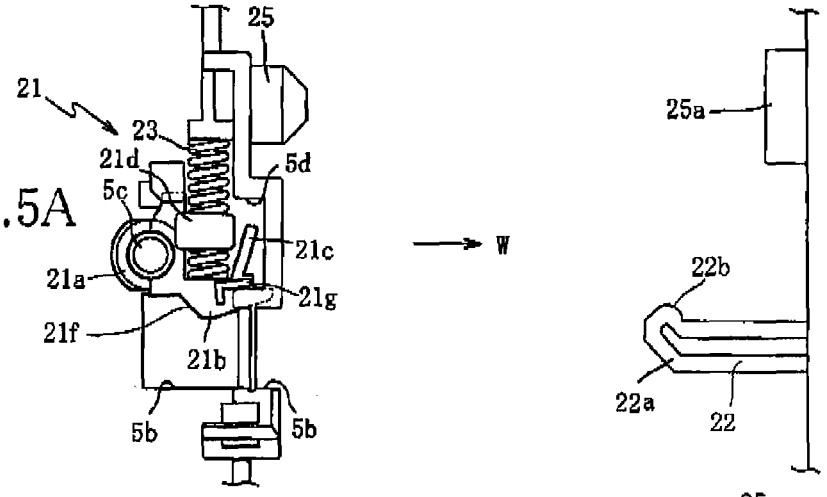
FIGS. 5A, 5B, and 5C are views for explaining a manner in which one of the two first engageable portions engages a corresponding one of two second engageable portions of the housing.
Figure 5B:
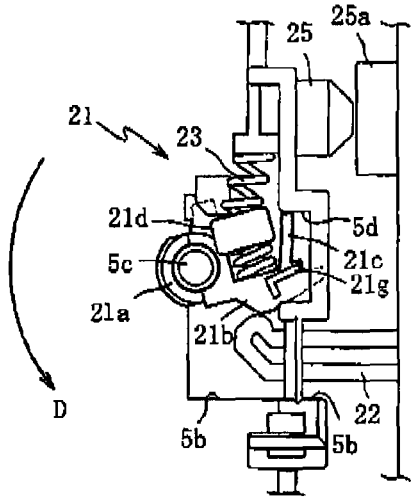
Figure 5C:
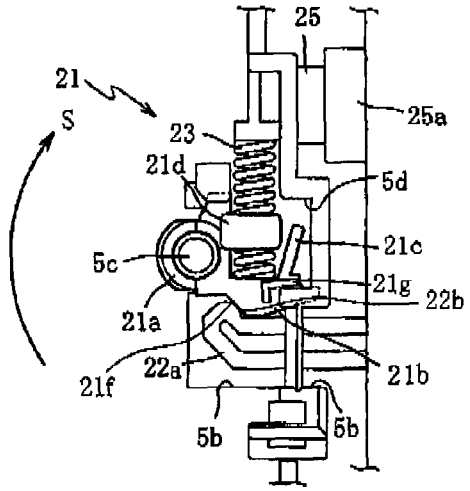

Next, there will be described a manner in which the two first engageable portions 21 and the two second engageable portions 22 are engaged with each other, by reference to FIGS. 5A, 5B, and 5C. FIGS. 5A, 5B, and 5C are plan views for explaining three steps of the manner in which the two first engageable portions 21 of the sheet-supply tray 5 are engaged with the two second engageable portions 22 of the housing 2, respectively.

First, as shown in FIG. 5A, the sheet-supply tray 5 is inserted in the housing 2 in a direction indicated by Arrow, W, (i.e., the direction P in FIG. 1), so that a distance between each first engageable portion 21 and the corresponding second engageable portion 22 is gradually decreased. Second, as shown in FIG. 5B, the tray 5 is further inserted, so that the second engageable portion 22 of the housing 2 enters the entrance hole 5*b* of the tray 5 and engages the operative portion 21*b* of the first engageable portion 21. When the tray 5 is further inserted, the first engageable portion 21 is rotated by the second engageable portion 22, in the direction D, as shown in FIG. 5B, till the first stopper portion 21*c* approaches, or accidentally butts on, the second stopper portion 5*d* of the tray 5 and the projecting portion 22*a* of the second engageable portion 22 climbs over the operative portion 21*b*. Then, as shown in FIG. 5C, the tray 5 is further inserted, and the first engageable portion 21 is rotated by the coil spring 23, against the second engageable portion 22, in the direction S opposite to the direction D. Thus, an inclined surface 22*b* of the projecting portion 22*a* of the second engageable portion 22 engages an inclined surface 21*f* of the operative portion 21*b* of the first engageable portion 21. Thus, the tray 5 is detachably attached to the housing 2. Since, owing to the respective engagements of the respective inclined surfaces 21*f* of the two first engageable portions 21 and the respective inclined surfaces 22*b* of the two second engageable portions 22, and the respective biasing forces of the two coil springs 23, the tray 5 is securely attached to the housing 2.

In the state in which the sheet-supply tray 5 is attached to the housing 2, if the feed roller (not shown), held in contact with the uppermost one of the recording sheets stacked in the tray 5, is rotated by the electric motor, then the uppermost recording sheet is separated from the other recording sheets remaining in the tray 5, by the bank wall 16, so that the uppermost recording sheet is supplied to the ink-jet printer head. Since the tray 5 is securely attached to the housing 2 such that the two first engageable portions 21 are engaged with the two second engageable portions 22, respectively in the above-described manner, the tray 5 is effectively prevented from rattling relative to the housing 2 and accordingly the recording sheets accommodated by the tray 5 are effectively positioned relative to the housing 2 in the widthwise direction of the tray 5 and the insertion direction P. Therefore, the recording sheets can be stably supplied to the ink-jet printer head.

As is apparent from the foregoing description of the illustrated embodiment, since the two first engageable portions 21 are at least partly provided in the rear space 16*e* located in rear of the inclined bank wall 16, respective amounts of projection of the two first engageable portions 21 from the rear-end wall of the sheet-supply tray 6 can be decreased or even zeroed and accordingly the size of the sheet supplying apparatus 26 as a whole can be reduced as such.

Also, in the illustrated embodiment, the two first engageable portions 21 are provided in the downstream-side end portion of the sheet-supply tray 5 in the insertion direction P in which the sheet-supply tray 5 is inserted in the housing 2. Therefore, if the user just inserts the tray 5 into the housing 2, the two first engageable portions 21 are engaged with the two second engageable portions 22, respectively. Thus, the tray 5 can be easily attached to the housing 2.

Also, in the illustrated embodiment, each of the two first engageable portions 21 is rotatable about the corresponding cylindrical projection 5*c*, owing to the biasing force of the corresponding coil spring 23. Thus, the operative portion 21*b* of the each first engageable portion 21 is biased toward the corresponding second engageable portion 22, so that the operative portion 21*b* is securely engaged with the second engageable portion 22. In addition, the holding portion 21*d* of the each first engageable portion 21 holds the intermediate portion of the corresponding coil spring 23. Therefore, when the each first engageable portion 21 is rotated and the coil spring 23 is flexed, the holding portion 21*d* restricts the direction in which the coil spring 23 is flexed, and thereby prevents the spring 23 from coming off the operative portion 21*b* and/or the spring-support portion 5*f* of the rear-end wall of the tray 5.

Figure 6A:
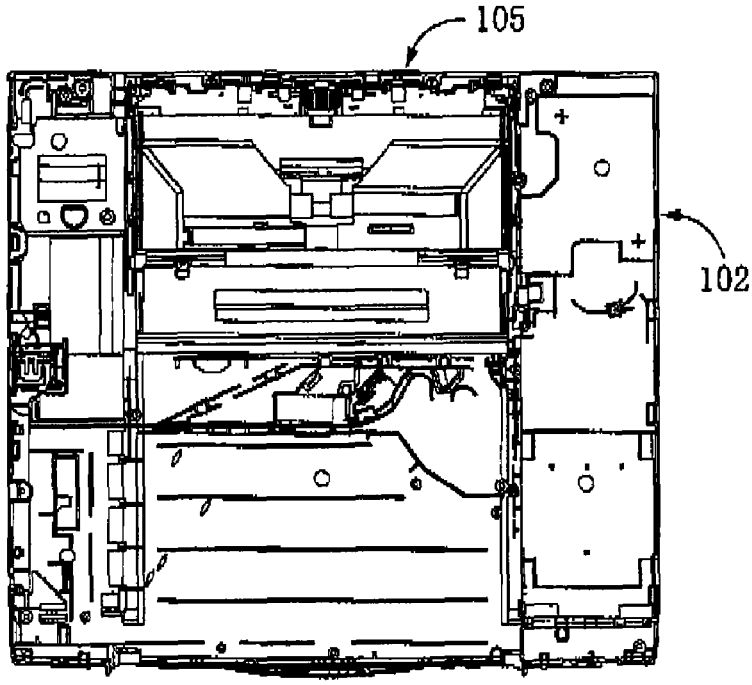
FIG. 6A is a plan view of a bottom portion of another multi-function peripheral machine as a second embodiment of the present invention, in a state in which a sheet-supply tray is inserted in a bottom portion of a housing and a bank wall identical with the bank wall employed in the first embodiment shown in FIG. 2 is removed from the sheet-supply tray.
Figure 6B:
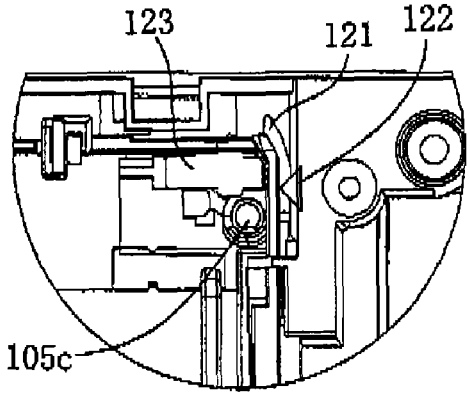
FIG. 6B is an enlarged view of a portion of the peripheral machine of FIG. 6A, showing one of two first engageable portions of the sheet-supply tray and a corresponding one of two second engageable portions of the housing.
Figure 6C:
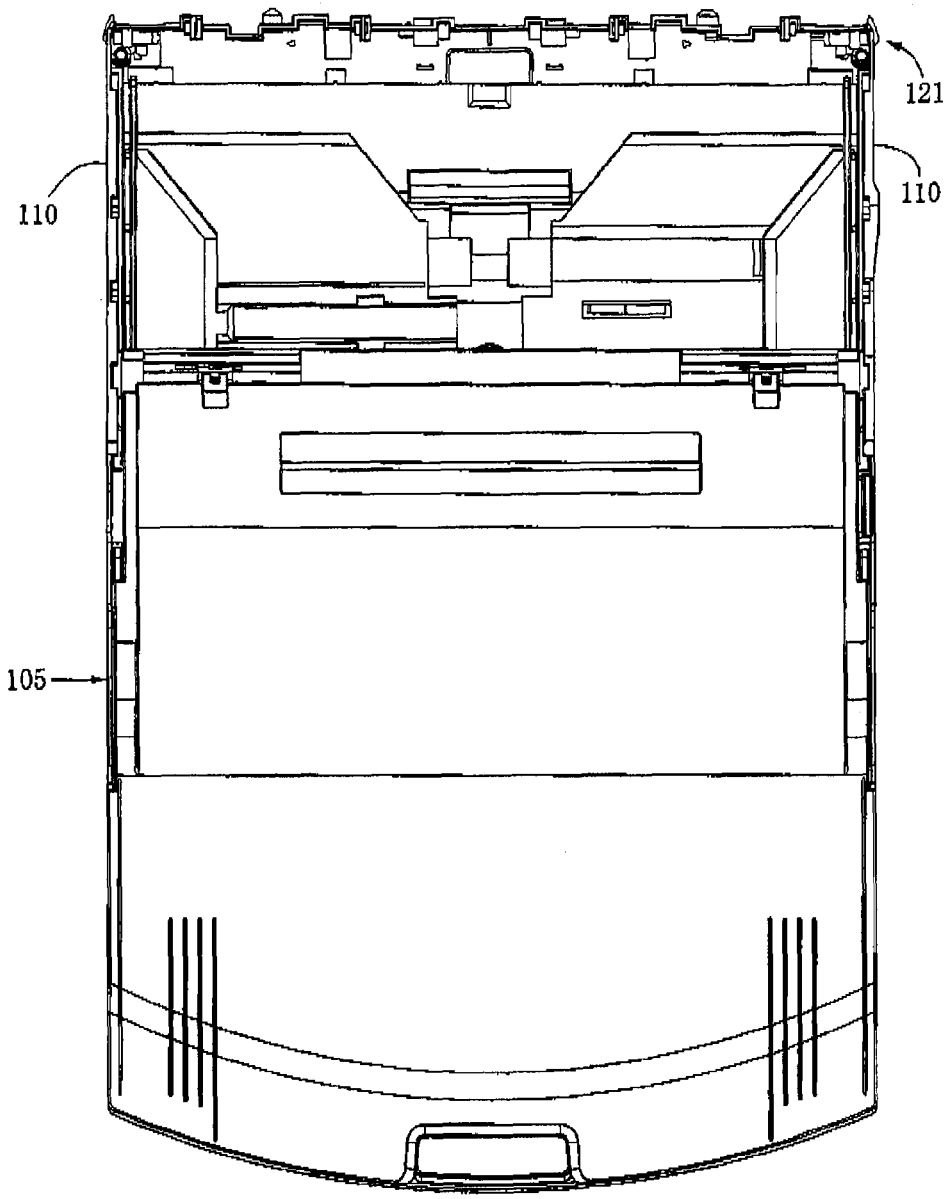
FIG. 6C is a plan view of the sheet-supply tray of FIG. 6A.
Figure 6D:
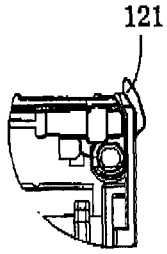
FIG. 6D is an enlarged view of a portion of the sheet-supply tray of FIG. 6C, showing the one first engageable portion of FIG. 6B.

FIGS. 6A, 6B, 6C, and 6D show another multi-function peripheral device as a second embodiment of the present invention, in a state in which a bank wall that is identical with the bank wall 16 employed in the first embodiment shown in FIGS. 1, 2, 3A, 3B, 4, 5A, 5B, and 5C, is removed from a sheet-supply tray 105. FIG. 6A shows a state in which the sheet-supply tray 105 is inserted in a bottom portion of a housing 102; FIG. 6B is an enlarged view of one of two first engageable portions 121, 121 and a corresponding one of two second engageable portions 122, 122; FIG. 6C is a plan view of the sheet-supply tray 105; and FIG. 6D is an enlarged view of one first engageable portion 121. Each of the two first engageable portions 121 of the sheet-supply tray 105 has a construction similar to that of each of the two first engageable portions 21 employed in the first embodiment, is rotatable about a corresponding one of two cylindrical projections 105*c* of the tray 105, and is biased by a corresponding one of two compression coil springs 123 toward a corresponding one of the two second engageable portions 122 of the housing 102. In the second embodiment, the housing 102 has the two second engageable portions 122 at respective positions that are symmetrical with each other with respect to a longitudinal centerline of the housing 102 that is parallel to an insertion direction in which the tray 105 is inserted into the housing 102, and that are opposed, in the state in which the sheet-supply tray 105 is inserted in the housing 102, to two side surfaces 110 of the sheet-supply tray 105 that extend in the insertion direction. In this embodiment, too, at least a portion of each of the two first engageable portions 121 is provided in a rear space located in rear of the bank wall, not shown, i.e., located between the bank wall and a rear end wall of the tray 105.

Figure 7A:
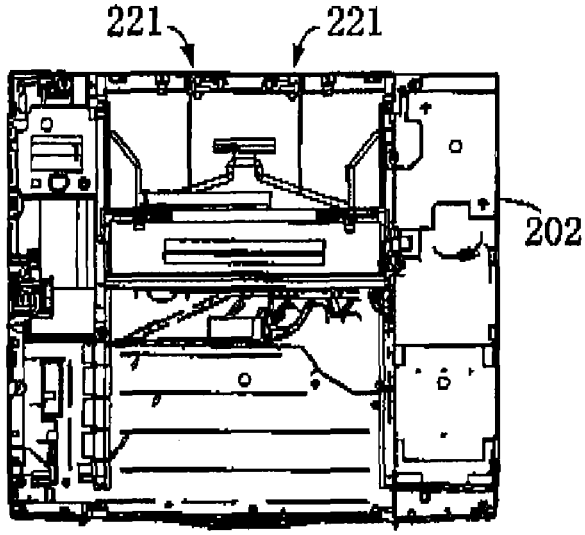
FIG. 7A is a plan view of a bottom portion of another multi-function peripheral machine as a third embodiment of the present invention, in a state in which a sheet-supply tray is inserted in a bottom portion of a housing (however, almost all portions of the sheet-supply tray, except for two first engageable portions thereof, are not shown)
Figure 7B:
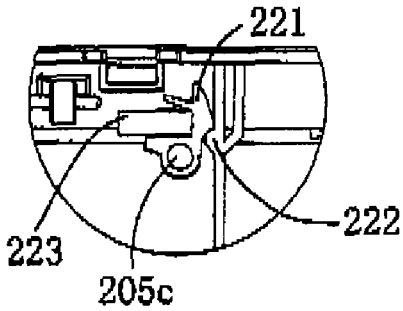
FIG. 7B is an enlarged view of a portion of the peripheral machine of FIG. 7A, showing one of the two first engageable portions and a corresponding one of two second engageable portions of the housing.
Figure 7C:
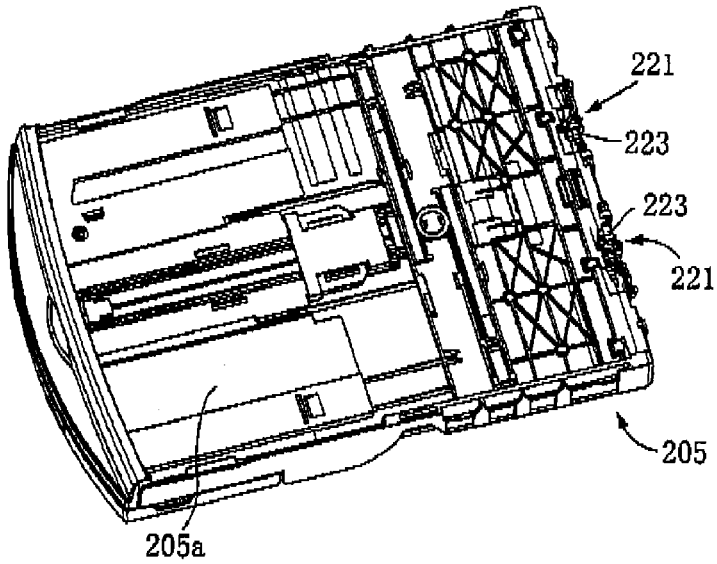
FIG. 7C is a perspective bottom view of the sheet-supply tray of FIG. 7A.
Figure 7D:
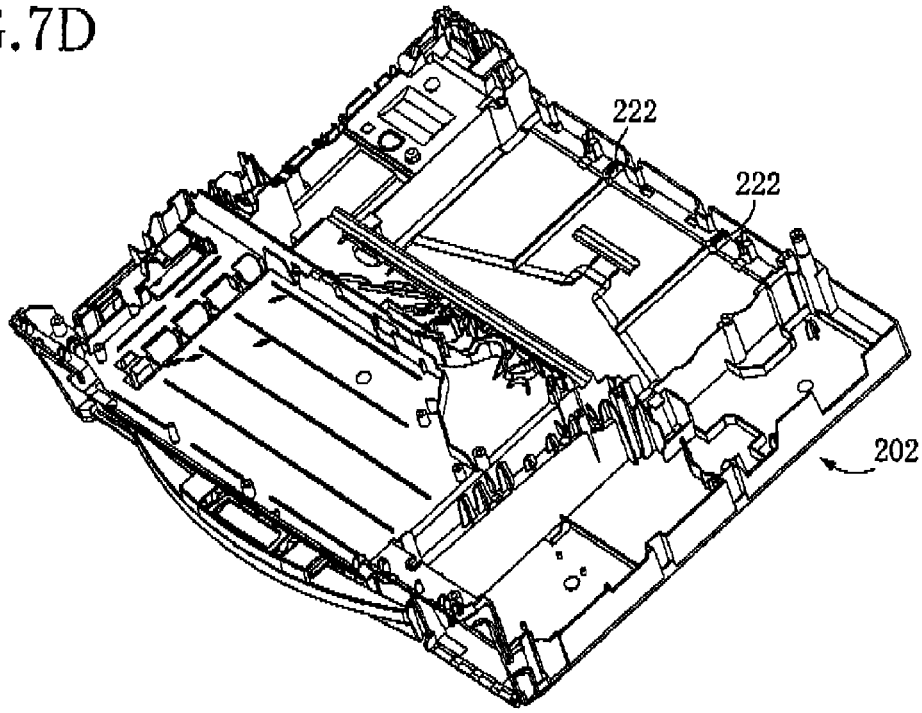
FIG. 7D is a perspective view of the bottom portion of the housing.

FIGS. 7A, 7B, 7C, and 7D show another multi-function peripheral device as a third embodiment of the present invention. FIG. 7A shows a state in which a sheet-supply tray 205 is inserted in a bottom portion of a housing 202 (however, only two first engageable portions 221, 221 of the tray 205 are shown); FIG. 7B is an enlarged view of one of the two first engageable portions 221 and a corresponding one of two second engageable portions 222, 222 of the housing 205; FIG. 7C is a perspective bottom view of the sheet-supply tray 105; and FIG. 7D is a perspective view of the bottom portion of the housing 202. The sheet-supply tray 205 has a bank wall, not shown, that is identical with the bank wall 16 employed in the first embodiment, but the bank wall is not shown. Each of the two first engageable portions 221 of the sheet-supply tray 205 has a construction similar to that of each of the two first engageable portions 21 employed in the first embodiment, is rotatable about a corresponding one of two cylindrical projections 205*c* of the tray 205, and is biased by a corresponding one of two compression coil springs 223 toward a corresponding one of the two second engageable portions 222 of the housing 202. In the third embodiment, the housing 202 has the two second engageable portions 222 at respective positions that are symmetrical with each other with respect to a longitudinal centerline of the housing 202 that is parallel to an insertion direction in which the tray 205 is inserted into the housing 202, and that are opposed, in the state in which the sheet-supply tray 205 is inserted in the housing 202, to a lower surface 205*a* of a bottom wall of the sheet-supply tray 205 that is opposite to a sheet-support surface thereof. Each of the two first engageable portions 221 does not project downward over a plane containing the lower surface 205*a*. In this embodiment, too, at least a portion of each of the two first engageable portions 221 is provided in a rear space located in rear of the bank wall, not shown, i.e., located between the bank wall and a rear end wall of the tray 205.

It is to be understood that the present invention may be embodied with various changes, modifications, and improvements that may occur to a person skilled in the art without departing from the spirit and scope of the invention defined in the appended claims.

What is claimed is:

1. A sheet supplying apparatus, comprising:

a sheet-supply tray which comprises a sheet-support surface and is configured to accommodate a plurality of sheets such that the sheets are supported on the sheet-support surface, wherein the sheet-supply tray includes at least one first engageable portion; and a housing including at least one second engageable portion, wherein said at least one first engageable portion of the sheet-supply tray engages with said at least one second engageable portion of the housing in response to insertion of the sheet-supply tray into the housing and disengages from said at least one second engageable portion in response to withdrawal of the sheet-supply tray from the housing, wherein the sheet-supply tray further includes a stationary guide wall extending in a first direction which is perpendicular to a direction in which the sheets are supplied from the sheet-supply tray, the stationary guide wall comprising:

an inclined guide surface which guides, in a second direction perpendicular to the first direction, a leading edge of each of the sheets supplied from the sheet-supply tray, and which extends from the sheet-support surface obliquely at a predetermined obtuse angle relative to the sheet-support surface; and an inclined rear surface which is opposite to the inclined guide surface and which cooperates with a plane containing the sheet-support surface to define a rear space having an acute angle and located in rear of the stationary guide wall, and wherein at least a portion of said at least one first engageable portion of the sheet-supply tray is located in the rear space and within a length of the inclined guide surface in the first direction.

2. The sheet supplying apparatus according to claim 1, wherein the sheet-supply tray includes a plurality of said first engageable portions, and the housing includes a plurality of said second engageable portions which are engaged, in the state in which the sheet-supply tray is inserted in the housing, with said plurality of first engageable portions, respectively.

3. The sheet supplying apparatus according to claim 1, wherein the stationary guide wall is located at a downstream-side end portion of the sheet-supply tray in an insertion direction in which the sheet-supply tray is inserted into the housing, and wherein said at least one first engageable portion is located downstream of the stationary guide wall in the insertion direction.

4. The sheet supplying apparatus according to claim 1, wherein the housing has said at least one second engageable portion at at least one position that is opposed, in the state in which the sheet-supply tray is inserted in the housing, to a downstream-side end surface of the sheet-supply tray in an insertion direction in which the sheet-supply tray is inserted into the housing.

5. The sheet supplying apparatus according to claim 1, wherein the housing has said at least one second engageable portion at least one position that is opposed, in the state in which the sheet-supply tray is inserted in the housing, to at least one side surface of the sheet-supply tray that extends in an insertion direction in which the sheet-supply tray is inserted into the housing.

6. The sheet supplying apparatus according to claim 1, wherein the housing has said at least one second engageable portion at at least one position that is opposed, in the state in which the sheet-supply tray is inserted in the housing, to a lower surface as one of opposite surfaces of a bottom wall of the sheet-supply tray, and wherein the sheet-support surface of the sheet-supply tray is provided by an other of the opposite surfaces of the bottom wall.

7. The sheet supplying apparatus according to claim 1, wherein one of:

(a) said at least one first engageable portion; and (b) said at least one second engageable portion includes:

at least one base portion which is rotatable about an axis line thereof; and at least one operative portion which is connected to said at least one base portion and which is engaged with an other of:

(a) said at least one first engageable portion; and (b) said at least one second engageable portion, when said at least one operative portion is rotated about said axis line in one of opposite directions, and wherein one of:

(c) the sheet-supply tray; and (d) the housing that corresponds to said one of:

(a) said at least one first engageable portion; and (b) said at least one second engageable portion includes at least one biasing member which biases said one of:

(a) said at least one first engageable portion; and (b) said at least one second engageable portion, in said one direction, so that:

(a) said at least one first engageable portion; and (b) said at least one second engageable portion are engaged with each other.

8. The sheet supplying apparatus according to claim 7, wherein the sheet-supply tray further includes at least one cylindrical projection, wherein said at least one first engageable portion includes:

said at least one base portion which has a cylindrical hole in which said at least one cylindrical projection fits such that said at least one base portion is rotatable about said at least one cylindrical projection; and said at least one operative portion which is connected to said at least one base portion and which is engaged with said at least one second engageable portion when said at least one operative portion is rotated about said at least one cylindrical projection in said one direction, and wherein the sheet-supply tray further includes said at least one biasing member which is supported, at one of opposite ends thereof, by said at least one operative portion and is supported, at an other of the opposite ends thereof, by at least one biasing-member support portion of the sheet-supply tray, and which biases said at least one operative portion in said one direction, so that said at least one operative portion is engaged with said at least one second engageable portion.

9. The sheet supplying apparatus according to claim 7, wherein said at least one biasing member comprises at least one spring.

10. The sheet supplying apparatus according to claim 9, wherein said at least one first engageable portion further includes at least one holding portion which is connected to said at least one base portion and which holds at least a portion of said at least one spring.

11. The sheet supplying apparatus according to claim 7, wherein the sheet-supply tray includes a pair of said first engageable portions and the housing includes a pair of said second engageable portions, wherein one pair of engageable portions of:

(a) the pair of first engageable portions; and (b) the pair of second engageable portions include:

respective said base portions, each of which is rotatable about the axis line thereof; and respective said operative portions which are connected to said respective base portions and which are simultaneously engaged with an other pair of engageable portions of:

(a) the pair of first engageable portions; and (b) the pair of second engageable portions, when said respective operative portions are simultaneously rotated about the respective axis lines of the corresponding base portions in respective engaging directions that are opposite to each other, and wherein said one of:

(c) the sheet-supply tray; and (d) the housing that corresponds to said one pair of engageable portions includes a pair of said biasing members which simultaneously bias the engageable portions of said one pair in said respective engaging directions so that the engageable portions of said one pair are simultaneously engaged with the engageable portions of said other pair, respectively.

12. The sheet supplying apparatus according to claim 11, wherein said other pair of engageable portions include respective projecting portions that project in opposite directions perpendicular to an insertion direction in which the sheet-supply tray is inserted into the housing, and that are simultaneously engageable with the respective operative portions of said one pair of engageable portions.

13. The sheet supplying apparatus according to claim 11, wherein said one pair of engageable portions further include respective first stopper portions which are connected to said respective base portions, respectively, and wherein said one of:

(c) the sheet-supply tray; and (d) the housing further includes respective second stopper portions which are located relative to said respective first stopper portions in a relative-positional relationship that when the engageable portions of said one pair are simultaneously engaged with the engageable portions of said other pair, respectively, such that a first middle position between the engageable portions of said one pair substantially coincides with a second middle position between the engageable portions of said other pair, at least one small gap is left between at least one of said respective first stopper portions and at least corresponding one of said respective second stopper portions, so that when the sheet-supply tray is inserted into the housing in an insertion direction, said respective second stopper portions are engageable with said respective first stopper portions so as to stop respective rotations of said respective operative portions in respective disengaging directions which are opposite to each other and each of which is opposite to a corresponding one of said respective engaging directions.

14. The sheet supplying apparatus according to claim 11, wherein said one pair of engageable portions further include respective first stopper portions which are connected to said respective base portions, respectively, wherein said one of:

(c) the sheet-supply tray; and (d) the housing further includes respective second stopper portions which are engageable with said respective first stopper portions so as to define respective limits of respective rotations of said respective operative portions in respective disengaging directions which are opposite to each other and each of which is opposite to a corresponding one of said respective engaging directions, wherein said respective second stopper portions define respective rotation spaces within which the corresponding first stopper portions are rotated when the corresponding base portions are rotated, and wherein each of said respective first stopper portions is elastically deformable relative to a corresponding one of said respective base portions, and said each first stopper portion is elastically deformed to be accommodated by a corresponding one of said respective rotation spaces and is elastically restored, in a state in which said each first stopper portion is accommodated by said corresponding rotation space, to an original shape thereof in which said each first stopper portion cannot be removed from said corresponding rotation space.

15. The sheet supplying apparatus according to claim 14, wherein said one of:

(c) the sheet-supply tray; and (d) the housing further includes a pair of cylindrical projections, and said one pair of engageable portions include said respective base portions each of which has a cylindrical hole in which a corresponding one of the cylindrical projections fits such that said each base portion is rotatable about said corresponding cylindrical projection, wherein in a first state in which said each base portion takes a first angular phase relative to said corresponding cylindrical projection, said each base portion is allowed to fit on said corresponding cylindrical projection while a corresponding one of said respective first stopper portions continues to have the original shape thereof and, in a second state in which said each base portion takes, relative to said corresponding cylindrical projection, a second angular phase which is different from the first angular phase and in which said corresponding first stopper portion is accommodated by a corresponding one of said respective rotation spaces, said each base portion cannot be removed from said corresponding rotation space when said corresponding first stopper portion continues to have the original shape thereof, and wherein when said each base portion is rotated from the first angular phase in which said each base portion has fit on said corresponding cylindrical projection, to the second angular phase, said corresponding first stopper portion is elastically deformed to be accommodated by said corresponding rotation space, and is elastically restored, in the state in which said corresponding first stopper portion has been accommodated by said corresponding rotation space, to the original shape thereof in which said corresponding first stopper portion is inhibited from being rotated back from the second angular phase toward the first angular phase, by a corresponding one of said respective second stopper portions.

16. The sheet supplying apparatus according to claim 1, wherein the sheet-supply tray includes at least one biasing member which biases said at least one first engageable portion such that said at least one first engageable portion and said at least one second engageable portion are engaged with each other, and wherein at least a portion of said at least one biasing member is located in the rear space.

17. The sheet supplying apparatus according to claim 16, wherein said at least one first engageable portion includes:

at least one base portion which is rotatable about an axis line thereof; and at least one operative portion which is connected to said at least one base portion and which is engaged with said at least one second engageable portion when said at least one operative portion is rotated about said axis line in one of opposite directions, and wherein said at least one biasing member biases said at least one first engageable portion in said one direction so that said at least one operative portion of said at least one first engageable portion is engaged with said at least one second engageable portion.

18. The sheet supplying apparatus according to claim 1, wherein the direction in which the sheets are supplied from the sheet-supply tray is the same as an insertion direction in which the sheet-supply tray is inserted into the housing.

19. A sheet supplying apparatus, comprising:

a housing; and a sheet-supply tray which supports a plurality of sheets and which is insertable into the housing, wherein the sheet-supply tray includes a pair of first engageable portions, wherein the housing includes a pair of second engageable portions which are engaged, in a state in which the sheet-supply tray is inserted in the housing, with the two first engageable portions of the sheet-supply tray, respectively, wherein one pair of engageable portions of:

(a) the pair of first engageable portions; and (b) the pair of second engageable portions include:

respective base portions each of which is rotatable about an axis line thereof; and respective operative portions which are connected to said respective base portions and which are simultaneously engaged with an other pair of engageable portions of:

(a) the pair of first engageable portions; and (b) the pair of second engageable portions, when said respective operative portions are simultaneously rotated about the respective axis lines of the corresponding base portions in respective engaging directions that are opposite to each other, wherein one of:

(c) the sheet-supply tray; and (d) the housing that corresponds to said one pair of engageable portions includes a pair of biasing members which simultaneously bias the engageable portions of said one pair in said respective engaging directions so that the engageable portions of said one pair are simultaneously engaged with the engageable portions of said other pair, respectively, wherein said one pair of engageable portions further include respective first stopper portions which are connected to said respective base portions, and wherein said one of:

(c) the sheet-supply tray; and (d) the housing further includes respective second stopper portions which are engageable with said respective first stopper portions so as to define respective limits of respective rotations of said respective operative portions in respective disengaging directions which are opposite to each other and each of which is opposite to a corresponding one of said respective engaging directions.

20. The sheet supplying apparatus according to claim 19, wherein said respective second stopper portions define respective rotation spaces within which said respective first stopper portions are rotated when the corresponding base portions are rotated, and wherein each of said respective first stopper portions is elastically deformable relative to a corresponding one of said respective base portions, and said each first stopper portion is elastically deformed to be accommodated by a corresponding one of said respective rotation spaces, and is elastically restored, in a state in which said each first stopper portion is accommodated by said corresponding rotation space, to an original shape thereof in which said each first stopper portion cannot be removed from said corresponding rotation space.

21. The sheet supplying apparatus according to claim 19, wherein said respective second stopper portions are located relative to said respective first stopper portions in a relative-positional relationship that when the engageable portions of said one pair are simultaneously engaged with the engageable portions of said other pair, respectively, such that a first middle position between the engageable portions of said one pair substantially coincides with a second middle position between the engageable portions of said other pair, at least one small gap is left between at least one of said respective first stopper portions and at least corresponding one of said respective second stopper portions, so that when the sheet-supply tray is inserted into the housing in an insertion direction, said respective second stopper portions are engageable with said respective first stopper portions so as to stop said respective rotations of said respective operative portions in said respective disengaging directions that are opposite to each other.

22. A sheet supplying apparatus, comprising:

a housing; and a sheet-supply tray which is configured to accommodate a plurality of sheets and which is insertable into the housing, wherein the sheet-supply tray comprises at least one cylindrical projection and at least one first engageable member, and wherein the housing comprises at least one second engageable portion which is engaged, in a state in which the sheet-supply tray is inserted in the housing, with said at least one first engageable member of the sheet-supply tray, wherein said at least one first engageable member comprises:

at least one base portion which has a cylindrical hole in which said at least one cylindrical projection fits such that said at least one base portion is rotatable about said at least one cylindrical projection; and at least one operative portion which is connected to said at least one base portion and which is engaged with said at least one second engageable portion, when said at least one operative portion is rotated about said at least one cylindrical projection in one of opposite directions, wherein the sheet-supply tray further comprises at least one biasing member which is supported, at one of opposite ends thereof, by said at least one operative portion and is supported, at an other of the opposite ends thereof, by at least one biasing-member support portion of the sheet-supply tray, and which is configured to bias said at least one operative portion in said one direction, such that said at least one operative portion is engaged with said at least one second engageable portion, wherein the sheet-supply tray further comprises a guide portion having an inclined guide surface which guides a movement of each of the sheets supplied from the sheet-supply tray, and wherein at least a portion of said at least one first engageable member is provided in a rear space located in rear of the guide portion.

23. A sheet supplying apparatus, comprising:

a housing;

a sheet-supply tray which is configured to accommodate a plurality of sheets and which is insertable into the housing, wherein the sheet-supply tray comprises:

at least one first engageable portion; and at least one biasing member which provides an elastic biasing force, wherein the housing comprises at least one second engageable portion which is engaged, in a state in which the sheet-supply tray is inserted in the housing, with said at least one first engageable portion of the sheet-supply tray owing to the elastic biasing force of said at least one biasing member, wherein said at least one first engageable portion has at least one first inclined surface which is inclined relative to an insertion direction in which the sheet-supply tray is inserted into the housing, said at least one second engageable portion has at least one second inclined surface which is inclined relative to the insertion direction, and said at least one biasing member applies the elastic biasing force to bias one of:

(a) said at least one first engageable portion; and (b) said at least one second engageable portion, toward an other of:

(a) said at least one first engageable portion; and (b) said at least one second engageable portion, so that:

(c) said at least one first inclined surface; and (d) said at least one second inclined surface are engaged, and held in contact, with each other, such that when the sheet-supply tray is removed from the housing by a user, said at least one first inclined surface is slid on, and eventually disengaged from, said at least one second inclined surface against the elastic biasing force of said at least one biasing member, wherein the sheet-supply tray further comprises a guide portion having an inclined guide surface which guides a movement of each of the sheets supplied from the sheet-supply tray, and wherein at least a portion of said at least one first inclined surface of said at least one first engageable portion is provided in a rear space located in rear of the guide portion.

24. A sheet supplying apparatus, comprising:

a sheet-supply tray which comprises a sheet-support surface and is configured to accommodate a plurality of sheets such that the sheets are supported on the sheet-support surface, wherein the sheet-supply tray includes at least one first engageable portion; and a housing including at least one second engageable portion, wherein said at least one first engageable portion of the sheet-supply tray engages with said at least one second engageable portion of the housing in response to insertion of the sheet-supply tray into the housing and disengages from said at least one second engageable portion in response to withdrawal of the sheet-supply tray from the housing, wherein the sheet-supply tray further includes a stationary guide wall extending in a first direction which is perpendicular to a direction in which the sheets are supplied from the sheet-supply tray, the stationary guide wall comprising:

an inclined guide surface which guides, in a second direction perpendicular to the first direction, a leading edge of each of the sheets supplied from the sheet-supply tray, and which extends from the sheet-support surface obliquely at a predetermined obtuse angle relative to the sheet-support surface; and an inclined rear surface which is opposite to the inclined guide surface and which cooperates with a plane containing the sheet-support surface to define a rear space having an acute angle and located behind the stationary guide wall, and wherein at least a portion of said at least one first engageable portion of the sheet-supply tray is located in the rear space behind the stationary guide wall.

25. The sheet supplying apparatus according to claim 24, wherein the direction in which the sheets are supplied from the sheet-supply tray is the same as an insertion direction in which the sheet-supply tray is inserted into the housing.

* * * * *